US011267495B2

(12) United States Patent
Bittoni et al.

(10) Patent No.: US 11,267,495 B2
(45) Date of Patent: Mar. 8, 2022

(54) SWITCH LOCK DEVICE FOR RAILWAY SWITCHING ACTUATORS

(71) Applicant: ALSTOM Ferroviaria S.p.A., Savigliano (IT)

(72) Inventors: Stefano Bittoni, Bologna (IT); Andrea Borromei-Colozzi, Bologna (IT)

(73) Assignee: ALSTOM FERROVIARIA S.P.A, Savigliano (IT)

( * ) Notice: Subject to any disclaimer, the term of this patent is extended or adjusted under 35 U.S.C. 154(b) by 341 days.

(21) Appl. No.: 16/400,410

(22) Filed: May 1, 2019

(65) Prior Publication Data

US 2019/0337541 A1 Nov. 7, 2019

(30) Foreign Application Priority Data

May 2, 2018 (EP) ..... 18305550

(51) Int. Cl.
*B61L 5/10* (2006.01)
*E01B 7/20* (2006.01)

(52) U.S. Cl.
CPC . *B61L 5/10* (2013.01); *E01B 7/20* (2013.01)

(58) Field of Classification Search
CPC ..... B61L 5/00; B61L 5/02; B61L 5/10; E01B 7/00; E01B 7/02; E01B 7/10; E01B 7/20
See application file for complete search history.

(56) References Cited

U.S. PATENT DOCUMENTS 1,960,377 A * 5/1934 Goodaire ..... B61L 5/10 246/448
2,208,449 A * 7/1940 Bone ..... B61L 5/107 403/135
2,730,319 A * 1/1956 Arnold ..... B61L 5/026 246/452
5,292,091 A 3/1994 Callegari et al.
6,325,334 B1 * 12/2001 Achleitner ..... B61L 5/00 246/452

(Continued)

FOREIGN PATENT DOCUMENTS

EP 0 320 636 6/1989
EP 1 012 022 6/2000

(Continued)

OTHER PUBLICATIONS

European Search Report, EP 18 30 5550, dated Oct. 23, 2018.

*Primary Examiner* — Robert J McCarry, Jr.
(74) *Attorney, Agent, or Firm* — Nixon & Vanderhye

(57) ABSTRACT

Disclosed is switch lock device of a railway switching actuator connected to a switching slide and a tie bar/locking slide of the actuator, the switching slide and a tie bar/locking slide being slidable one over the other to lock a blade of a railway switch in a closed position, the switch lock including an oscillating catch unit oscillating between two positions, engaging either a stationary step of a casing of the actuator or a head surface of the switching slide. The oscillating catch unit links to the end of the tie bar by a spring actuated mechanism blocking oscillation of the oscillating catch unit in an unlocked position corresponding to the engagement of the switching slide. During switching, the tie bar compresses the spring actuated mechanism, and the oscillating catch unit is free to oscillate towards a locking position, engaging the step of the casing of the actuator.

5 Claims, 2 Drawing Sheets

(56) References Cited

U.S. PATENT DOCUMENTS 7,484,695 B2 2/2009 Cavalli

FOREIGN PATENT DOCUMENTS

| | | |
|---|---|---|
| FR | 2 338 832 | 8/1977 |
| JP | 2014-177754 | 9/2014 |
| WO | WO 99/20511 | 4/1999 |
| WO | WO 2005/049402 | 6/2005 |

* cited by examiner

SWITCH LOCK DEVICE FOR RAILWAY SWITCHING ACTUATORS

BACKGROUND OF THE INVENTION

Field of the Invention

The present invention relates to a switch lock device for railway switching actuators, particularly for high-speed lines. A switching actuator is a device suitable for switching blades of a railway switch, such actuator being positioned at the toes of the blades or at the frog of a railway switch.

Description of the Related Art

Document U.S. Pat. No. 5,292,091 discloses a switch lock device for a railway switching actuator arranged to be associated with one of the blades of a railway switch. In the casing of the switch lock device a lower slide, called switching slide, and an upper slide, called locking slide, are guided so that one is slidable over the other transversely with respect to the blades. The switching and locking slide are interconnected by a device for coupling and locking the blade in the closed position, the so called switch lock, this device comprising two oscillating catch units.

Each oscillating catch unit couples the switching slide to the locking slide for bringing a blade into contact with its stock rail, and locks the locking slide in said contact position to prevent any movement in the opposite direction not caused by the actuation of the switching slide itself.

The ends of the stems of each oscillating catch unit can oscillate freely, and they extend in opposite directions parallel to the locking slide. At their free ends, the stems have transversely widened heads forming upper catches and lower catches arranged to engage with respective steps of the casing of the actuator and of the switching slide.

Each oscillating catch unit can assume a downward directed angular position in which the locking slide is coupled to the switching slide so that during the sliding movement of the switching slide, the respective oscillating catch unit is held securely in its position of engagement with the step of the switching slide.

On the other hand, the oscillating catch units may assume an upward directed angular position for locking the locking slide to prevent any displacement from the terminal position of the railway switch actuator not caused directly by the movement of the switching slide. In this angular locking position, the upper catch of the respective oscillating catch unit engages with the associated step of the casing of the actuator.

The problem of this solution is that it does not allow reaching a SIL-4 (Safety Integrity Level) level regarding fail-safe detection of the locking condition. In particular it does not allow have the SIL-4 function of sensing the failure of any component included in the cinematic chain of the mechanical lock of the blade. It is not possible to correctly detect a failure of the operation of the switch lock device due for example to a tie bar damage or to obstacles preventing the blade to correctly reach its final position.

There is therefore the need to provide a switch lock device for a railway switching actuator which allows to achieve a SIL-4 level in fail safe detecting failures of the operation the switch lock device itself, thus overcoming the limitations of the prior art solutions.

BRIEF SUMMARY OF THE INVENTION

This and other objects are achieved by a switch lock device for a railway switching actuator according to the present invention.

Preferred embodiments of the invention are the subject matter of the dependent claims, whose content is to be understood as forming an integral part of the present description.

BRIEF DESCRIPTION OF THE DRAWINGS

Further characteristics and advantages of the present invention will become apparent from the following description, provided merely by way of non-limiting example, with reference to the enclosed drawings, in which.

DETAILED DESCRIPTION OF THE PREFERRED EMBODIMENTS

Briefly, the switch lock device for a railway switching actuator of the present invention is based on the switch lock disclosed into document U.S. Pat. No. 5,292,091 and includes, in addition, elastic means which prevent the switch lock from reaching the locking position if a failure occurs inside the railway switch, thus also preventing the generation of an end of stroke signal representing the correct operation of the railway switch itself.

The switching slide is arranged to push the oscillating catch unit of the switch lock to move a tie bar or actuator rod of the railway switching actuator. Said tie bar or actuator rod basically corresponds to the locking slide above indicated, in particular, the locking slide is the end portion of said tie bar. By oscillating from a low position to a high position, the oscillating catch unit makes the locking/unlocking of the tie bar in a final position.

The elastic means prevent the switch lock from being activated in case of failure of the switching maneuver. In such a case, control means usually associated with the railway switching actuator and arranged to send to an interlocking system of the high-speed line an end of stroke signal representative of the correct end of the switching maneuver, do not send any signal.

The elastic means stably maintain the oscillating catch unit of the switch lock in the position corresponding to the deactivated condition. Said elastic means undergo a deformation (compression) action exerted by the tie bar during the final phase of the switching maneuver, said deformation making the oscillating catch unit free to oscillate in the locking position. During the final phase of the switching maneuver, if a failure occurs preventing the switching maneuver to be completed, the deformation action on the elastic means is not exerted and the oscillating catch unit does not oscillate in the locking position. In this case, the oscillating catch unit remains engaged with the tie bar preventing it to reach its locking position, thus preventing the generation of the end of stroke signal.

In the switch lock device of the present invention the oscillating catch unit is not directly articulated to the tie bar but elastic means, preferably a spring actuated mechanism, are provided between the tie bar and the oscillating catch unit itself, which operate either blocking or making free the oscillation of the catch unit.

The oscillating catch unit also forms a spacer which, in case of failure, prevents the tie bar from reaching its final position.

Figure 1:
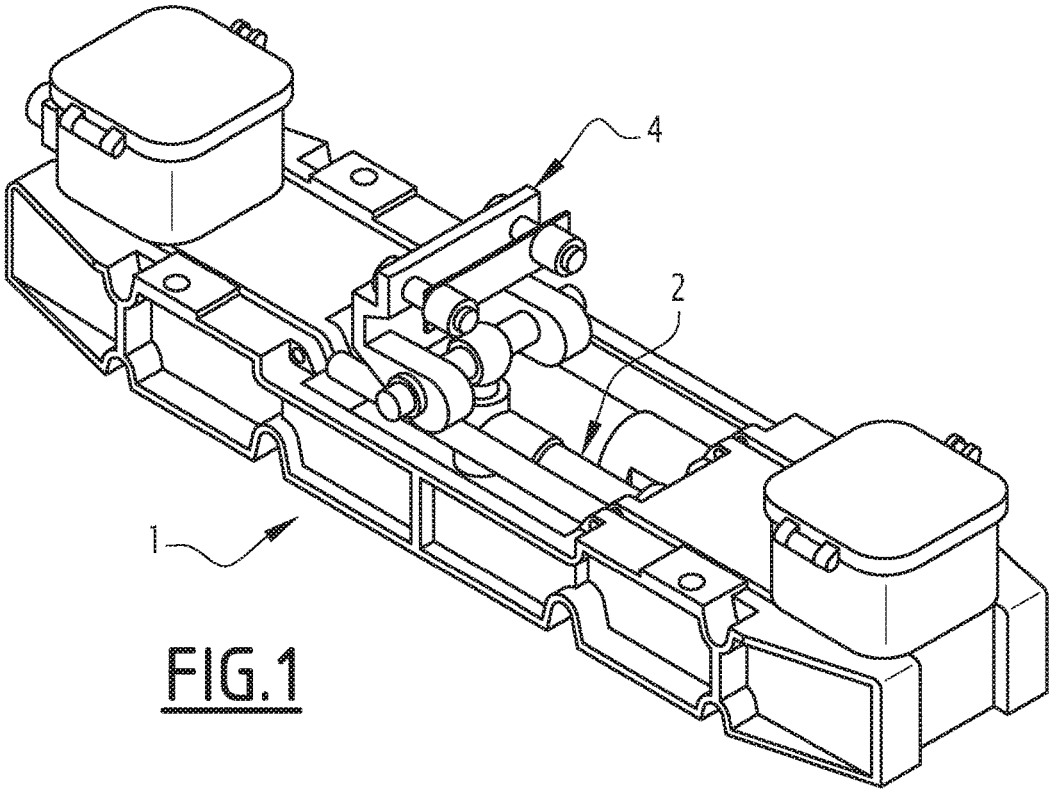
FIG. 1 shows a perspective view of a railway switch actuator.

FIG. 1 shows a perspective view of a railway switch actuator 1, preferably an oleo dynamic double effect cylinder, having a tie bar 2 provided with securing means 4 for connecting the tie bar 2 to a frog of a railway switch. The railway switch actuator 1 comprises two switch locks according to the present invention.

Figure 2:
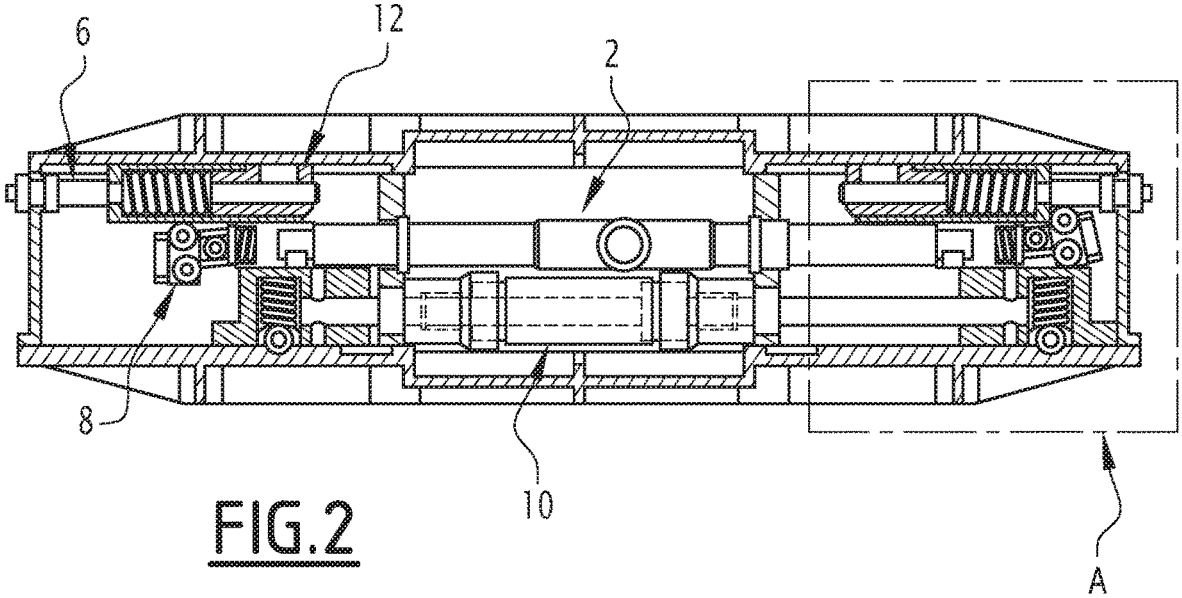
FIG. 2 shows a top view of the railway switch actuator.
Figure 3:
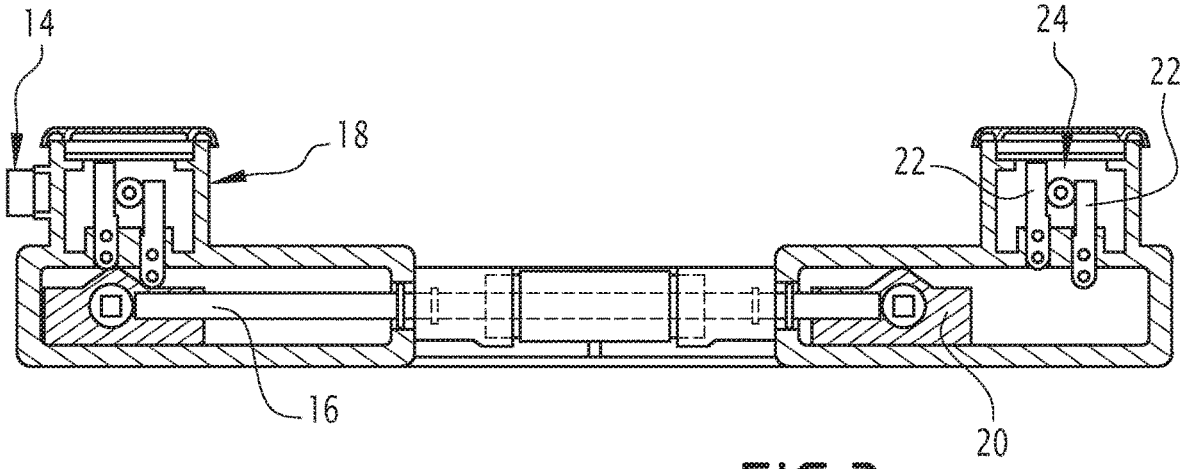
FIG. 3 shows a lateral view of the railway switch actuator.

FIG. 2 shows a top view of the railway switch actuator 1 while FIG. 3 shows a lateral view of the railway switch actuator 1.

The generic architecture of the railway switch actuator 1 is constructed according to document U.S. Pat. No. 5,292,091 and the main components are a stroke setting unit 6, arranged in a manner known per se to define the stroke that the railway switch actuator 1 will cause to the blades of the railway switch, an oscillating catch unit 8 of a switch lock comprising elastic means, disclosed in detail here below, a double effect cylinder 10, the tie bar 2, a block 12 of the casing of the railway switch actuator 1 which has an integrated sensing device and which is responsible of the trailing sensing, a connector 14 arranged to connect the railway switch actuator 1 to a wayside cabin of the high-speed line, a switching slide 16 and a case 18 for hosting control contacts arranged to switch in case of correct end of a switching maneuver so as to send to a remote interlocking system a corresponding end of stroke signal.

The switching slide 16 is provided with a cam surface 20 controlling the sliding of toothed rods 22 engaging a pinion 24 which switches the controls contacts.

Figure 4:
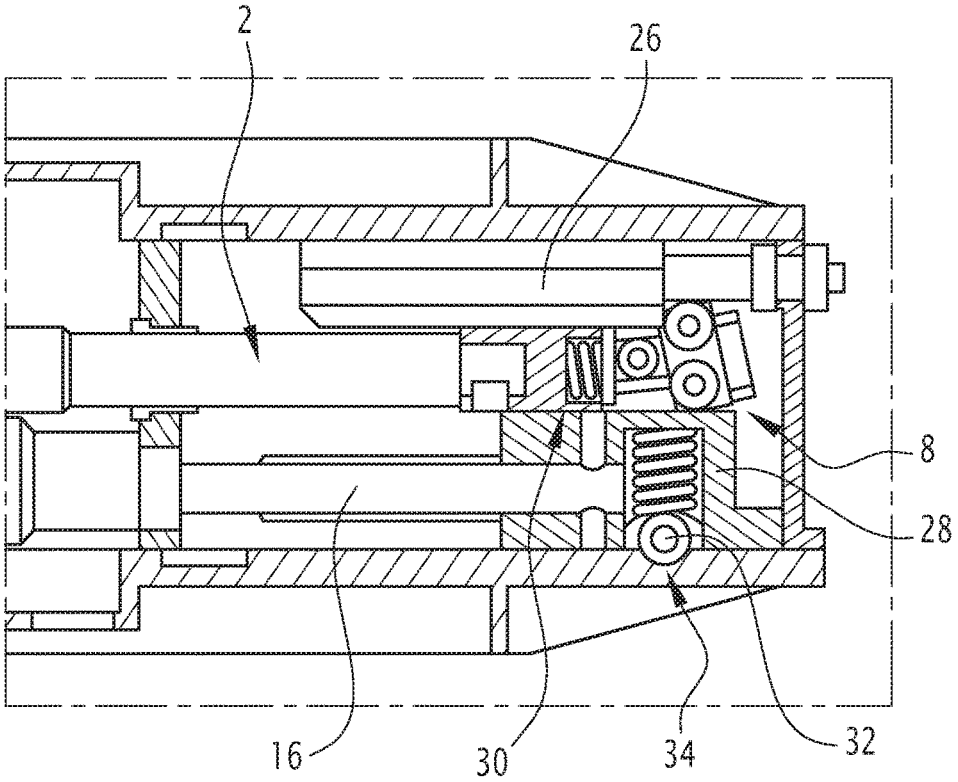
FIG. 4 is an enlargement of the area A of FIG. 2.

FIG. 4 is an enlargement of the area A of FIG. 2. The switch lock comprises an oscillating catch unit 8 articulated at the end of the tie bar 2 in an oscillating way between two positions.

The oscillating catch unit 8 has a T or fork shape engaging respectively a stationary step 26 of the block 12 and a head surface 28 of the switching slide 16.

The oscillating catch unit 8 is not freely linked to the end of the tie bar 2 but its degrees of freedom are limited by interposing a spring actuated mechanism 30, preferably a spring, arranged to block the oscillation of the oscillating catch unit 8 in an unlocked position corresponding to the condition of engagement of the switching slide 16.

The spring actuated mechanism 30 operates in such a way that the spring 30 stably maintains the oscillating catch unit 8 in a blocked condition relatively to its oscillation.

When during a switching maneuver the tie bar 2 exercises a compression action on the spring 30, the oscillating catch unit 8 is made free to oscillate towards the locking position in which it engages the step 26 of the block 12.

If the tie bar 2 and/or the rail fastening system is damaged, the tie bar 2 cannot exercise a force on the spring 30 and the oscillating catch unit 8 cannot be displaced in the locking condition. In such a case, the oscillating catch unit 8 remains engaged with the switching slide 16 and operates as a spacer interposed between a leading end surface of the switching slide 16 and an end wall of the casing of the railway switch actuator 1.

In this unlocked condition, a roller 32 of the switching slide 16 cannot reach a correct final position and the cam surface 20 of the switching slide 16 cannot make the toothed rods 22 slide and consequently switch the control contacts, so that no end of stroke signal is generated and sent to the interlocking system of the high-speed line.

When the damage of the tie bar 2 and/or of the rail fastening is on the opposite part of the tie bar 2, this damage is sensed and signaled during the inverse stroke in a similar manner.

During a maneuver, if a failure occurs preventing the displacement from being completed, the deformation action on the spring 30 cannot be exerted and the oscillating catch unit 8 does not oscillate in the locking position. The oscillating catch unit 8 remains engaged with the tie bar 2, preventing it from reaching the final position and thus preventing switching of the corresponding control contacts.

Clearly, the principle of the invention remaining the same, the embodiments and the details of production can be varied considerably from what has been described and illustrated purely by way of non-limiting example, without departing from the scope of protection of the present invention as defined by the attached claims.

The invention claimed is:

1. A switch lock of a railway switching actuator connected to a switching slide and a tie bar/locking slide of said actuator, said switching slide and the tie bar/locking slide being slidable one over the other to lock a blade of a railway switch in a closed position, the switch lock comprising:

an oscillating catch articulated at an end of the tie bar in an oscillating manner between two positions in which the oscillating catch respectively engages a stationary step of a casing of the railway switching actuator and a head surface of the switching slide, the oscillating catch being linked to the end of the tie bar by a spring-actuated mechanism configured to block oscillation of the oscillating catch in an unlocked position corresponding to engagement of the switching slide so that, when the tie bar exercises a compression on the spring-actuated mechanism during a switching maneuver, the oscillating catch is made free to oscillate towards a locking position in which the oscillating catch engages the step of the casing of the actuator.

2. The switch lock according to claim 1, wherein the switching slide is provided with a cam surface controlling sliding of toothed rods engaging a pinion which switches control contacts that are configured to switch at a correct end of a switching maneuver to send a corresponding end of stroke signal to a remote interlocking system associated with the railway switch actuator.

3. The switch lock according to claim 1, wherein the spring-actuated mechanism is a spring.

4. The switch lock according to claim 1, wherein the oscillating catch has a T shape or a fork shape.

5. The switch lock according to claim 2, wherein, in said unlocked condition, a roller of the switching slide cannot reach a predetermined final position so that the cam surface cannot make the toothed rods slide to switch the control contacts, so that no end of stroke signal is generated.

* * * * *